United States Patent [19]

Blackaby

[11] Patent Number: 4,577,856

[45] Date of Patent: Mar. 25, 1986

[54] THEATRICAL RISERS

[76] Inventor: Dale W. Blackaby, 913 S. 13th St., Pekin, Ill. 61554

[21] Appl. No.: 524,055

[22] Filed: Aug. 17, 1983

[51] Int. Cl.[4] ..... A63J 5/00

[52] U.S. Cl. ..... 272/25

[58] Field of Search ..... 272/3, 9, 21, 25; 46/21, 31; 108/33, 34, 38, 41, 56.1, 56.3, 90, 111, 151, 153, 154, 156, 157, 159; 52/6, 7, 8, 182, 183, 668; 297/442

[56] References Cited

U.S. PATENT DOCUMENTS

| | | | |
|---|---|---|---|
| 1,952,817 | 3/1934 | Neary | 217/12 R |
| 2,366,677 | 1/1944 | Rosenthal | 211/148 |
| 2,575,593 | 11/1951 | Peery | 20/1.126 |
| 2,657,964 | 11/1953 | Watrous | 108/157 |
| 2,704,383 | 3/1955 | Berg | 20/1.126 |
| 3,327,882 | 6/1967 | Andrews | 220/4 F |
| 3,346,317 | 10/1967 | Peggs | 312/258 |
| 3,512,857 | 5/1970 | Butera | 312/107 |
| 3,564,790 | 2/1971 | Rehfeld | 52/183 |
| 3,692,201 | 9/1972 | Garduna | 217/12 R |
| 4,003,167 | 1/1977 | Saunders | 46/21 X |

FOREIGN PATENT DOCUMENTS

| | | | |
|---|---|---|---|
| 140329 | 3/1920 | United Kingdom | 46/21 |

OTHER PUBLICATIONS 2 page advertisement Encore Staging.

*Primary Examiner*—Robert A. Hafer
*Assistant Examiner*—Arnold W. Kramer
*Attorney, Agent, or Firm*—Beveridge, DeGrandi and Weilacher

[57] ABSTRACT

A theatrical riser comprises a triangular top panel supported on a base which is formed of three vertical rectangular panels. The rectangular panels are interconnected at the corners of the base by projections which are integral with a panel and extend through a slot on the adjacent panel. The projections have upturned or downturned portions which extend over the exterior surface of the adjacent panel to prevent horizontal withdrawal of the projections from the slots. A kit for forming such risers is also disclosed.

20 Claims, 9 Drawing Figures

FIG.1
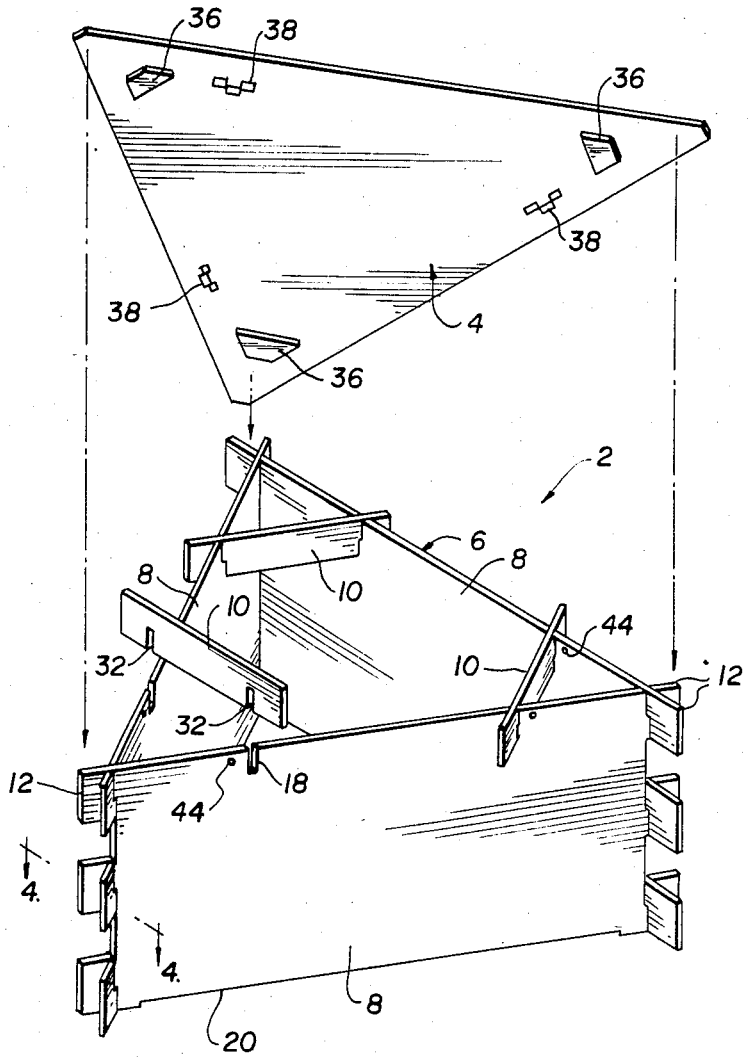
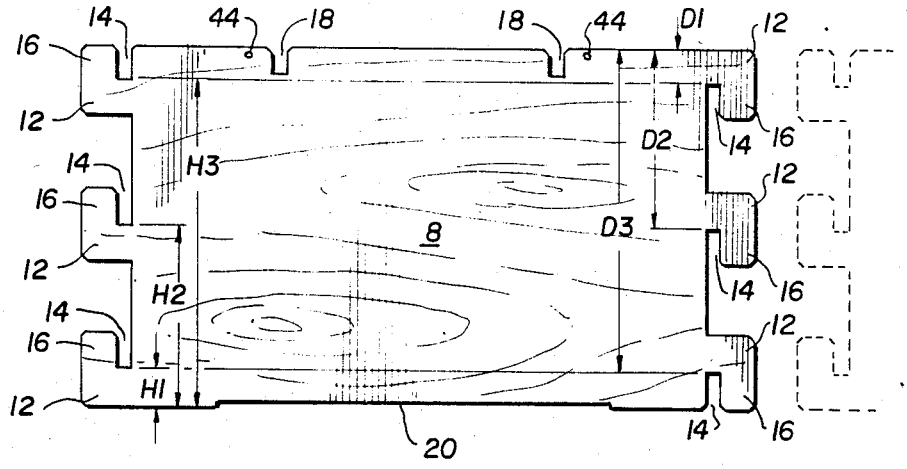
FIG.2

THEATRICAL RISERS

BACKGROUND

This invention relates to collapsible theatrical risers of the type used by dramatic and choral groups.

Many types of theatrical risers are presently available. These include triangular modules formed of horizontal triangular top panels supported on bases which are formed of three interconnected vertical panels. In such risers, the vertical panels are connected together by hinges.

The present invention is less complicated than previously available risers; and, it is attractive, convenient to manufacture, easy to use and fully collapsible.

SUMMARY OF THE INVENTION

In one respect, the invention relates to a collapsible theatrical riser formed of a horizontal top panel which is supported on a base formed of three vertical panels, wherein the vertical panels are connected to each other by a corner connection means which is believed to be novel in a riser. Each corner connection includes vertical slots in one panel and projections in the other panel. The projections are integral and coplanar with their respective panel, and they extend horizontally through the slots in the other panel. The projections have portions which extend over the exterior surface of the slotted panel to prevent horizontal withdrawal of the projections from the slots.

Preferably, both ends of all vertical panels have slots and projections provided at their corner connections. On each vertical panel, the slots at one end have lower ends which lie at the same height as the upper ends of the slots at the other end of the panel. Further, in each panel, the upper ends of the slots at one end thereof are spaced from the upper edge of the panel by distances which are equal to the distances between the lower edge of the panel and the lower ends of the slots located at the other end of the panel. To provide the module with enhanced stability, cross braces with downwardly facing slots are used to form a bracing connection between adjacent panels. The upper edges of the respective panels are provided with additional slots which receive the downwardly facing slots of the cross braces so that portions of the cross braces lie against the interior and exterior surfaces of the vertical panels.

Also, it is preferred to provide the lower surface of the horizontal top panel with positioning means which engage the surfaces of the vertical panels and prevent horizontal shifting movement of the top panel on the base. The positioning means may also be operable to tighten the corner connection by exerting horizontal forces on the panels near the corner connections.

At the corner connections, the panels preferably lie at an acute angle relative to each other. The slots are cut perpendicular to their respective panels and have widths which are greater than the thicknesses of the respective panels. The slot width is related to the panel thickness so that the exterior and interior surfaces of each projection lie in contact with edges of the opposite walls of the slot which receives the projection.

In another respect, the invention relates to a kit of parts which are connectible to form a set of risers for drama and choral groups. This kit includes a plurality of triangular panels, and a plurality of rectangular panels which are interconnectible to form bases for the triangular panels. A first group of rectangular panels are interconnectible to form bases for low risers, and the panels in this group have a first length and a first width. A second group comprises rectangular panels which are interconnectible to form bases for high risers. The panels in this group have a length which is equal to the first length and a width which is greater than the first width. Each of the rectangular panels has opposed side edges and opposed end portions. Each end portion has slots which extend through the thickness of the panel and projections which are coplanar with the panel. The slots at one end portion of the panel have ends which are spaced by predetermined distances from one side edge of the panel, and the slots at the other end portion of the panel have ends which are spaced from the other side edge of the panel by distances which are equal to the predetermined distances. Preferably, the kit of parts also includes a plurality of cross braces which are provided with slots which are engageable with corresponding slots located in the side edges of the rectangular panels.

Persons familiar with the field of the invention will realize that the invention may be practiced in many forms. A preferred embodiment is shown in the accompanying drawings and described in the following text.

BRIEF DESCRIPTION OF THE DRAWINGS

FIG. 1 is an exploded view of a riser constructed according to the invention.

FIG. 2 illustrates one of the rectangular panels which forms the base of the riser.

DESCRIPTION OF A PREFERRED EMBODIMENT

Figure 3:
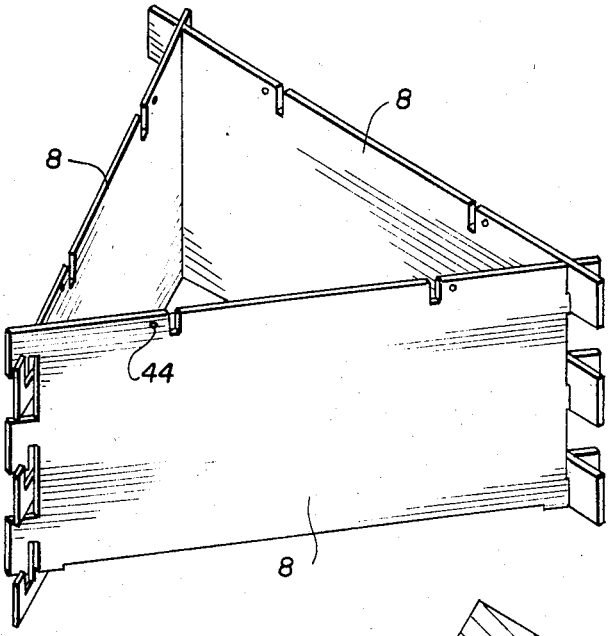
FIG. 3 shows the final step in connecting the three verticle panels of the base.

Referring to FIG. 1, it will be seen that a module 2 constructed according to the invention has a triangular top panel 4 which is supported on a base 6 formed of three interconnected vertical panels 8. To provide additional stability, cross braces 10 are used to connect adjacent vertical panels 8 and provide supplemental support to the horizontal top panel 4.

The corner connection means between the adjacent panels can best be understood by referring to FIG. 2 which shows the construction of one of these panels 8, and immediately adjacent thereto, a broken line representation of one end of another panel to which it is to be connected. Both ends of the panel 8 are cut in a pattern which provides three projections 12 which are integral and coplanar with the panel. The panel also has three vertical slots at both ends, disposed where they will receive the projections 12 of the adjacent panel. Each projection also has a downturned or upturned portion 16 which will extend over the exterior surface of the adjacent panel to prevent horizontal withdrawal of the projections 12 from the slots 14.

The upper edge of each panel has a pair of slots 18 which are spaced inwardly from the corner connection means and are adapted to receive the cross braces 10 when the riser is assembled. The lower edge of each panel has a wide shallow notch 20 which forms a recess extending a major portion of the panel length. This notch 20 is desirable because it will prevent any rocking movement of the panel in situations where the module rests on an uneven or convex floor.

Referring to the dimensional markings in FIG. 2, it will be noted that the slots 14 formed at the left end of the panel have their lower ends located at the same heights H1, H2 and H3 as the upper ends of the slots 14 at the right end of the panel. Furthermore, the slots 14 at the right end of the panel have their upper ends spaced from the upper side edge of the panel by distances D1, D2 and D3 which are equal to the distances H1, H2 and H3 between the lower side edge of the panel and the lower ends of the slots 14 at the left end of the panel.

Figure 4:
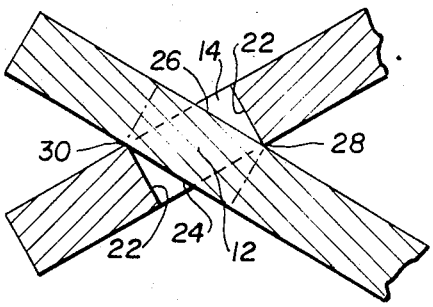
FIG. 4 is a horizontal sectional view taken through the corner connection means.

As shown in FIG. 4, the slots 14 in the ends of the panels 8 have walls 22 which lie perpendicular to the panels. The slot width is greater than the panel thickness so that, when the panels are disposed at acute angles relative to each other, the exterior and interior surfaces 24 and 26 of the projection will contact the edges 28 and 30 of the slot.

Figure 9:
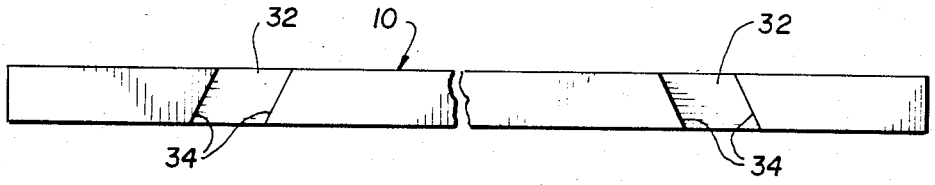
FIG. 9 is a broken bottom plan view of a corner brace used in the riser.

The corner braces 10 have downwardly facing slots 32. When the module is assembled, these slots are vertically aligned with the slots 18 in the panels 8 as shown in FIG. 1. The slots 32 are oriented obliquely in the cross braces as shown in FIG. 9 so that, when assembled, the slot faces 34 will lie substantially parallel to the interior and exterior surfaces of the vertical panels. The total depth of the slots 18 and 32 is equal to the width of the cross braces so that the upper edges of the vertical panels 8 and the upper edges of the cross braces 10 will be in a common horizontal plane when the apparatus is assembled as shown in FIG. 1.

Figure 6:
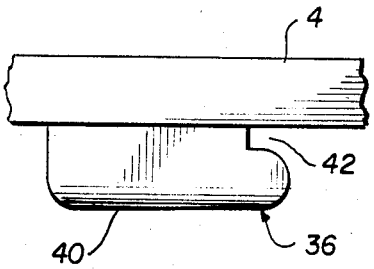
FIGS. 6 and 7 are side and bottom plan views of a corner block which is mounted on the top panel.
Figure 8:
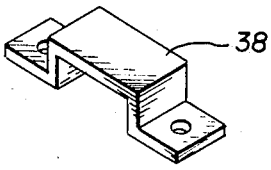
FIG. 8 is a perspective view of a clip which is attached to the top panel.
Figure 7:
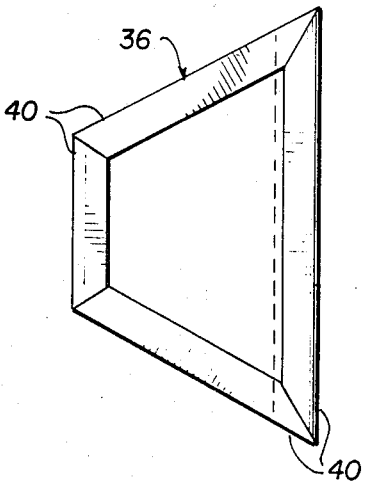

The triangular top panel is large enough so that, when assembled, it will overlie the entirety of the vertical panels 8, including the projections 12. The top panel has, on its lower surface, three corner blocks 36 and three clips 38, the details of which are shown in FIG. 8. The blocks 36 serve as positioning means for engaging the interior surfaces of the vertical panels 8. As shown in FIGS. 6 and 7, each of these blocks is trapezoidal and is rounded in the perimetral areas 40. The upper surface of the block is relieved adjacent to the lower surface of the top panel to provide a notch 42 which will give workers a hand hold when handling the top panels 4. The entrance to this notch is also rounded as shown in FIG. 6. The spacing between the corner blocks is such that they will exert a horizontal force on the panels when the top panel is forced downwardly during assembly of the module. This horizontal force is applied near the corner connections in order to tighten the fit of the corner connections.

After the top panel 4 is properly positioned on the base, it is locked to the base by lock pins (not shown) which are inserted through small holes 44 in the vertical panels into clips 38 on the lower surface of the top panel. These clips are hat-shaped as shown in FIG. 8.

Figure 5:
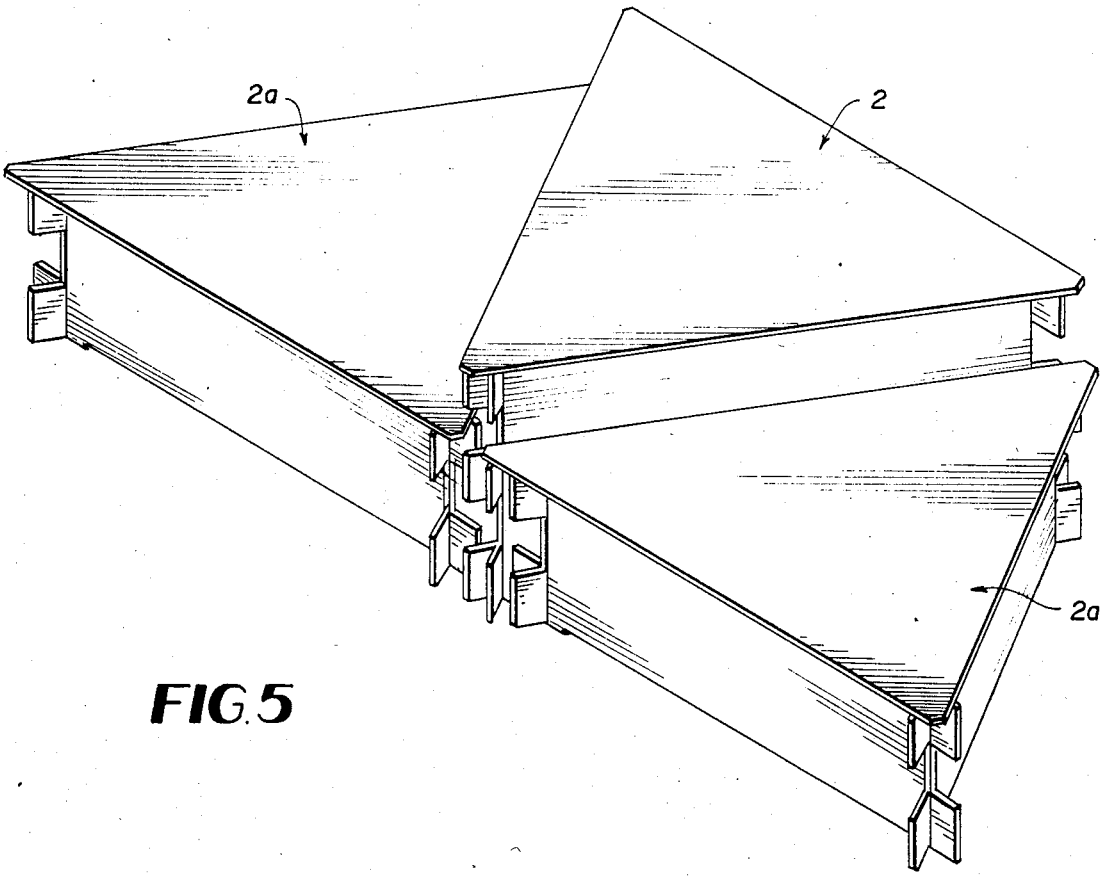
FIG. 5 illustrates an assembly comprising three riser units.

Normally, the modules will be used in sets. A set of three modules is shown in FIG. 5 where it will be noted that there is a high riser 2 and two low risers 2*a*. The risers 2*a* are substantially identical to each other. Each of the vertical panels in the high riser 2 has a length which is equal to and a width which is greater than the lengths and widths of the corresponding panels of the low risers 2*a*.

From the foregoing, it will be appreciated that the risers are formed from kits which include the panels 4 and 8. The kits are quite compact which permits them to be carried in family vehicles such as station wagons. The components are easily carried to the site of the choral or drama event, and they are easily set up by first connecting two vertical panels 8, connecting a third vertical panel 8 to an unconnected end of the two connected panels and then, as shown in FIG. 3, making the final connection. In each instance, the connection is made by raising an end of one panel, moving it horizontally until its slots 14 are vertically aligned with the corresponding slots in the other panel, and then lowering the raised panel to interengage the slots and projections at the corner connection.

After the vertical panels are interconnected to form the triangular base, three cross braces are placed in their slots and the top panel 4 is placed on the base and forced downwardly so that the corner blocks 36 bear against the vertical panels to tighten the corner connections. Lock pins are inserted through holes 44 into the clips 38 to retain the top panel 4 in position. These steps are repeated to form additional modules, and the modules are moved to mutually adjacent positions to complete the assembly.

Persons who are familiar with the field of the invention will appreciate that the inventin provides an uncomplicated, effective, and esthetically pleasing riser for choral or theatrical performances. They will also recognize that the invention may take many forms other than the embodiment disclosed in this specification. Accordingly, it is emphasized that the invention, rather than limited to this embodiment, encompasses modifications thereto and variations thereof which fall within the spirit of the following claims.

I claim:

1. A collapsible theatrical riser usable by choral groups, drama groups and the like, comprising, a base formed of a plurality of vertical panels, a horizontal top panel which is supported on said base; each of said vertical panels having an exterior surface, an interior surface, an upper edge, a lower edge and two vertical ends; said base having corners where said vertical panels are connected to each other, each of said panels having hook and slot connection means formed in both of its ends, said hooks being similar to each other but being directed upwardly at one end of the panel and downwardly at the other end of the panel, one hook at each end of a panel having an upper edge which extends to and is aligned with the upper edge of the panel.

2. A riser according to claim 1 wherein each of said vertical panels has, at one end, slots with lower ends which are at the same height (H1, H2, H3) as the upper ends of the slots at the other end of the vertical panel.

3. A riser according to claim 1 wherein, in each vertical panel, the upper ends of the slots at one end of the panel are spaced from the upper edge of the panel by distances (D1, D2, D3) which are equal to the distances (H1, H2, H3) between the lower edge of the panel and the lower ends of the slots located at the other end of the panel.

4. A riser according to claim 1 wherein the upper edges of the vertical panels are provided with additional slots which are spaced from the vertical ends, said risers having cross braces which lie in said additional slots to provide a bracing connection between adjacent vertical panels, said cross braces having downwardly facing slots which are vertically aligned with said additional slots so that portions of said cross braces lie against the interior and exterior surfaces of said vertical panels.

5. A riser according to claim 1 wherein said horizontal top panel has a lower surface provided with positioning means for engaging the interior surfaces of the vertical panels, said positioning means being operable to prevent horizontal shifting movement of the top panel on the base.

6. A riser according to claim 5 wherein said positioning means is operable to tighten the base by exerting a horizontal force on said vertical panels.

7. A riser according to claim 1 in combination with and adjacent to a second riser and a third riser, said second and third risers being substantially identical to each other and having a lower height than said first riser.

8. A riser according to claim 1 wherein said slots have widths which are greater than the thicknesses of their respective panels, said panels at their connected corners being at an acute angle relative to each other and to the vertical walls of the slots of adjacent panels.

9. A riser according to claim 1 wherein the top panel is positioned to overlie the entirety of the vertical panels.

10. A collapsible theatrical riser usable by choral groups, drama groups and the like, comprising, a base formed of a plurality of vertical panels, a horizontal top panel which is supported on said base; each of said vertical panels having an exterior surface, an interior surface, an upper edge, a lowr edge and two vertical ends; said base having corners where said vertical panels are connected to each other, hooks and slots formed in the ends of the panels and being operable as connection means for connecting the panels together to form said base, said connection means being located at corners of the base, said hooks having interior and exterior surfaces which correspond to the interior and exterior surfaces of their respective panels, said slots which are formed in the ends of the panels being vertical and having widths which are greater than the thicknesses of the hooks inserted therein, said slots which are formed in the ends of the panels having internal sidewalls, said hooks lying in the slots at an orientation where the internal sidewalls of the slots are angled relative to the surfaces of the hooks in the slots, said slots having diagonally opposite edges which bear against opposite surfaces of the hooks whereby the panels are securely connected together at said corners to provide a substantially rigid structure.

11. A riser according to claim 10, wherein both ends of each panel have said hooks and said slots.

12. A riser according to claim 11 wherein the hooks at each end of a panel extend in a direction which is opposite to the direction of the hooks on the opposite end of the panel.

13. A riser according to claim 10 wherein each of said vertical panels has, at one end, slots with lower ends which are at the same height (H1, H2, H3) as the upper ends of the slots at the other end of the vertical panel.

14. A riser according to claim 10 wherein, in each vertical panel, the upper ends of the slots at one end of the panel are spaced from the upper edge of the panel by distances (D1, D2, D3) which are equal to the distances (H1, H2, H3) between the lower edge of the panel and the lower ends of the slots located at the other end of the panel.

15. A riser according to claim 10 wherein the upper edges of the panels are provided with additional slots which are spaced from the corner connection means, said risers having cross braces which lie in said additional slots to provide a bracing connection between adjacent panels, said cross braces having downwardly facing slots which are vertically aligned with said additional slots so that portions of said cross braces lie against the interior and exterior surfaces of said vertical panels.

16. A riser according to claim 10 wherein said horizontal top panel has a lower surface provided with positioning means for engaging the interior surfaces of the vertical panels, said positioning means being operable to prevent horizontal shifting movement of the top panel on the base.

17. A riser according to claim 10 wherein said positioning means is operable to tighten the corner connection means by exerting a horizontal force on said panels near the corner connection means.

18. A riser according to claim 10 in combination with and adjacent to a second riser and a third riser, said second and third risers being substantially identical to each other and havng a lower height than said first riser.

19. A riser according to claim 10 wherein the top panel is positioned to overlie the entirety of the vertical panels including the projections thereof.

20. A kit of parts for forming a collapsible theatrical riser, comprising, a plurality of panels which are interconnectible to form a base, each of said panels when forming said base being vertical and having an exterior surface, an interior surface, an upper edge, a lower edge, and two ends;

hooks and slots formed in the ends of the panels and being operable as connection means for connecting the panels together to form a said base, said slos being vertical when the panels are vertical and having widths which are greater than the thicknesses of the panels, a panel which is mountable on a said base to provide a deck for supporting performers who use the risers, said slots having internal sidewalls disposed to lie at an angle to the opposite surfaces of hooks inserted therein, said slots having diagonally opposite edges which are disposed to bear against opposite surfaces of hooks inserted therein, whereby the panels are securely connected together at said corners to provide a substantially rigid structure.

* * * * *